United States Patent [19]

John, Jr. et al.

[11] Patent Number: 4,966,177

[45] Date of Patent: Oct. 30, 1990

[54] ULTRASONIC TUBE CLEANING SYSTEM

[75] Inventors: Clarence D. John, Jr., Penn Hills Twp.; Beverly T. Jarabak, Murrysville; Joseph G. Cigich, Salem Township, all of Pa.

[73] Assignee: Westinghouse Electric Corp., Pittsburgh, Pa.

[21] Appl. No.: 414,637

[22] Filed: Sep. 28, 1989

Related U.S. Application Data

[63] Continuation of Ser. No. 07/205,520, Jun. 13, 1988, abandoned, which is a continuation of Ser. No. 06/799,684, Nov. 19, 1985, abandoned.

[51] Int. Cl.[5] ..... B08B 9/02

[52] U.S. Cl. ..... 134/61; 134/1; 134/18; 134/22.1; 134/22.14; 134/23; 134/66; 134/73; 134/83; 134/171; 134/184; 15/88; 198/463.5

[58] Field of Search ..... 134/1, 18, 22.1, 22.14, 134/23, 61, 66, 73, 83, 171, 184; 198/463.5; 15/88

[56] References Cited

U.S. PATENT DOCUMENTS

| | | | |
|---|---|---|---|
| 1,280,825 | 10/1918 | Pacz | 134/1 |
| 1,901,455 | 3/1933 | Kennedy | 134/83 |
| 3,033,710 | 5/1962 | Hightower et al. | 134/1 |
| 3,059,788 | 10/1962 | True | 198/463.5 |
| 3,156,248 | 11/1964 | Rand | 134/83 |
| 3,198,489 | 8/1965 | Finch | 259/1 |
| 3,210,788 | 10/1965 | Holliday | 15/88 |
| 3,330,401 | 7/1967 | Ablstedt | 198/463.5 |
| 3,371,770 | 5/1968 | Graham et al. | 198/167 |
| 3,440,094 | 4/1969 | Adam et al. | 134/1 |
| 3,441,754 | 4/1969 | Hony | 310/9.1 |
| 3,449,163 | 6/1969 | Mobius et al. | 134/1 |
| 3,572,352 | 3/1971 | Koopman | 134/1 |
| 3,889,798 | 6/1975 | Jurgens et al. | 198/127 |
| 4,046,592 | 9/1977 | Westervelt et al. | 134/1 |
| 4,116,597 | 9/1978 | Dunstan | 425/110 |
| 4,194,922 | 3/1980 | Gransell et al. | 134/1 |
| 4,194,922 | 3/1980 | Gransell et al. | 134/1 |
| 4,375,991 | 3/1983 | Sachs et al. | 134/1 |
| 4,392,506 | 7/1983 | Tanaka et al. | 134/83 |

FOREIGN PATENT DOCUMENTS

| | | | |
|---|---|---|---|
| 2003252 | 7/1971 | Fed. Rep. of Germany | 198/463.5 |
| 3028713 | 2/1982 | Fed. Rep. of Germany | 198/463.5 |
| 227820 | 9/1968 | U.S.S.R. . | |
| 1234316 | 5/1984 | U.S.S.R. | 198/463.5 |
| 1266813 | 10/1986 | U.S.S.R. | 198/463.5 |

*Primary Examiner*—Asok Pal

[57] ABSTRACT

A system for ultrasonically cleaning tubes includes an elongated cleaning tank adapted to hold a quantity of detergent-containing water and a series of transducers mounted on the bottom wall of the tank in a generally linear arrangement extending between opposite end walls of the tank. The transducers generate ultrasonic cavitational energy within the water in the tank. An inclined upper tube entry ramp supported above the tank guides delivery of tubes in single file fashion into the tank to a reversely inclined middle tube transfer ramp. The inclined middle ramp guides transfer of tubes in single file fashion into the water in the tank and to a lower tube soak ramp having a tube accumulating terminal end. The lower ramp feeds the tubes across the tank within the water and above the transducers therein to its tube accumulating end such that each tube will pass through and be cleaned by the cavitation energy in the water. A conveyor supported in a generally vertical position in the tank and having two sets of tube lifting cradles thereon is operable to pick up one tube at a time at the accumulating end of the lower ramp with one set of cradles and lift the one tube from the water to a discharge location above the tank to remove the tube from the tank before another tube is picked up by the other set of cradles on the conveyor.

14 Claims, 3 Drawing Sheets

ULTRASONIC TUBE CLEANING SYSTEM

This application is a continuation, of application Ser. No. 07/205,520 filed June 13, 1988, now abandoned, which is a continuation of application Ser. No. 799,684, filed 11/19/1985, now abandoned.

BACKGROUND OF THE INVENTION

1. Field of the Invention

The present invention relates generally to fuel assemblies for nuclear reactors and, more particularly, is concerned with an automated system and method for ultrasonically cleaning fuel rod tubes which is used near the end of the tube fabrication process.

2. Description of the Prior Art

In most nuclear reactors, the reactor core is comprised of a large number of elongated fuel assemblies. Conventional designs of these fuel assemblies include a multiplicity of fuel rods held in an organized array by grids spaced along the fuel assembly length. The grids are attached to a plurality of control rod guide thimbles. Top and bottom nozzles on opposite ends of the fuel assembly are secured to the guide thimbles which extend above and below the opposite ends of the fuel rods.

The fuel rods each contain fissile material and are grouped together in an array which is organized so as to provide a neutron flux in the core sufficient to support a high rate of nuclear fission and thus the release of a large amount of energy in the form of heat. All materials present into the reactor core will be irradiated by the fissile material in the fuel rods and, in turn, will interact with it. In order to produce the desired neutron flux in the core, the nuclear interaction and thus the chemical composition of all components introduced into the reactor core must be known and taken into consideration. Therefore, the materials composing all such components are carefully selected in order to obtain the desired interaction with the neutron flux.

To control what materials are introduced into the core, extensive measures and steps are taken to maintain a clean environment not only in the reactor facility itself but also in the facilities where the components are manufactured. One part of this overall effort toward achieving a high standard of cleanliness is the cleaning of component parts during fabrication to remove foreign matter therefrom. In the case of the tubes used in fuel rods, one of the final steps in their fabrication is a thorough cleaning of the interior and exterior of each tube. The conventional cleaning technique used involves bundling large numbers of tubes, for example three hundred, in a group, submerging the bundle into a tank of cleaning solution for a predetermined time, and then submerging the bundle into a rinse tank to flush impurities from the tube surfaces.

However, there are several problems with this conventional technique. First, the tube cleaning solution typically used is methylene chloride toluene which is environmentally undesirable. Also, the steps of gathering and bundling the tubes are inherently inefficient and cumbersome, while the manipulation of the large bundles of tubes demands the use of a crane and operator. Consequently, a need has emerged to improve and automate the way in which fuel rod tube cleaning is carried out.

SUMMARY OF THE INVENTION

The present invention provides an ultrasonic tube cleaning system and method designed to satisfy the aforementioned needs. Unlike the previously-used batch operation wherein the tubes were cleaned a bundle at a time, the cleaning system of the present invention introduces a technique which operates on a first-in first-out basis, allowing individual processing of tubes in a relatively continuous manner. The tube entry, soak and removal subsystems are relatively automatic so as not to require operator intervention between the moments that each tube enters and exits the cleaning system. Also, ultrasonic energy is transmitted from a series of elongated transducers at the bottom of a water-filled tank to the tubes as they travel through the tank to clean the tubes. This technique results in cleaner tubes while at the same time eliminating the environmentally undesirable methylene chloride toluene cleaning solution in favor of a biodegradeable detergent with water. While the invention is disclosed in connection with cleaning of fuel rod tubes, it is just as applicable to cleaning other tubes, such as control rod tubes.

Accordingly, the present invention is directed to a system and method for ultrasonically cleaning tubes which includes the operative steps of: (a) generating ultrasonic cavitational energy within a liquid in a tank; (b) delivering tubes individually into the liquid within the tank; (c) feeding the tubes across the tank within the liquid therein such that each tube will pass through and be cleaned by the cavitation energy in the liquid; and (d) removing the tubes from the liquid within the tank. Also, the tubes are delivered individually along a switchback path into the liquid. Further, the tubes are fed in single file fashion across the tank within the liquid. Then, the tubes are likewise removed one tube at a time from the liquid within the tank. Before being removed, the tubes are accumulated after being fed across the tank.

More particularly, the tubes are delivered by means in the form of upper and lower pluralities of oppositely inclined tracks which define the switchback path along which the tubes are fed individually into the liquid within the tank. Further, a bottom plurality of elongated slightly inclined tracks disposed below the upper and lower tracks and across the tank define a generally linear path along which the tubes are fed individually through the ultrasonic cavitation energy in the liquid.

In addition, the tubes are removed by means in the form of a plurality of flexible members being operable for movement about endless paths extending between the tube feeding tracks and a tube discharge location above the tank. Corresponding pairs of tube cradles are attached to the flexible members such that corresponding ones of the cradles in the pairs thereof are disposed in an unloading position adjacent the tube discharge location when corresponding others of the cradles are disposed in a loading position adjacent the tube feeding tracks. The corresponding cradles in the pairs thereof are adapted to pick up only one tube at a time.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
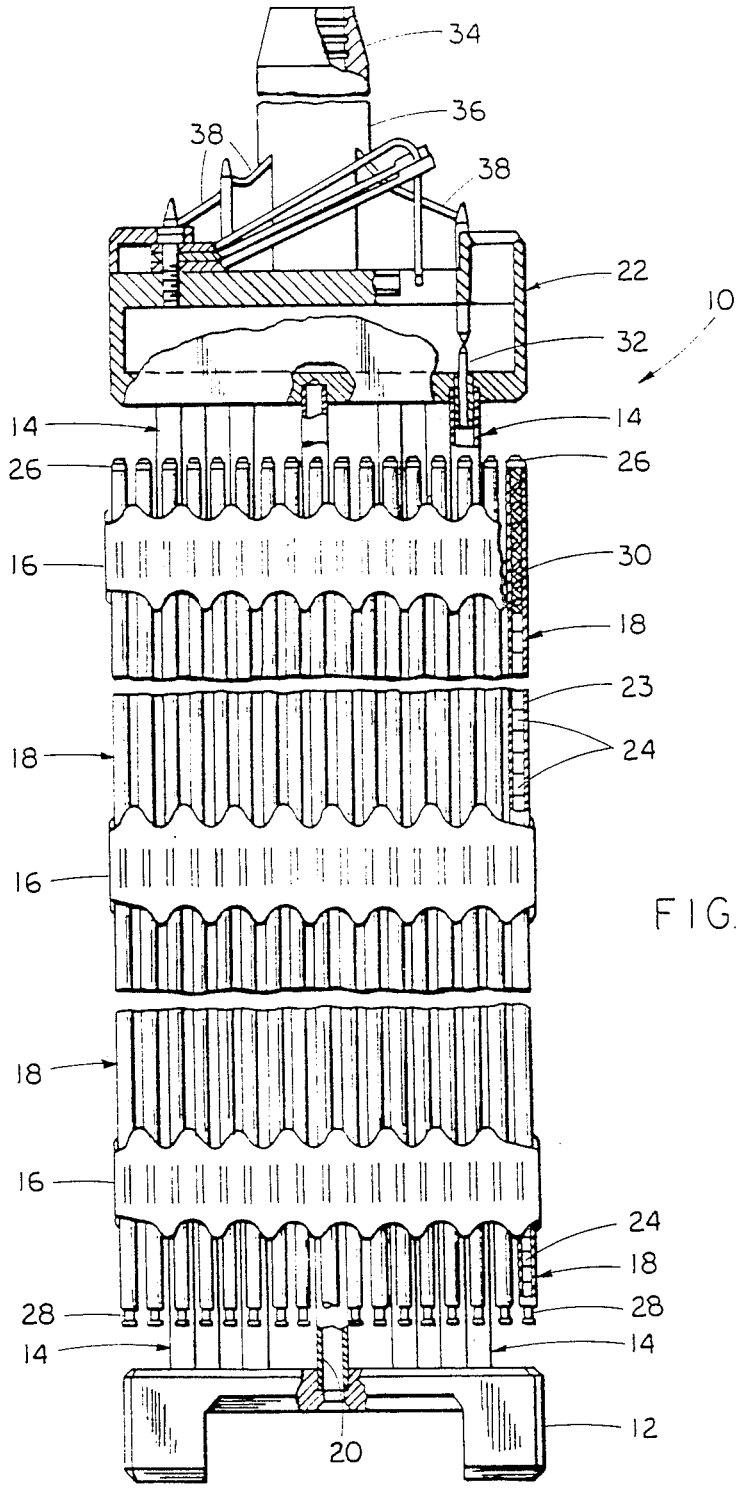
FIG. 1 is an elevational view, partly in section, of a fuel assembly which incorporates fuel rods whose tubes are cleaned during fabrication thereof by employment of the system and method of the present invention, the fuel assembly being illustrated in vertically foreshortened form with parts broken away for clarity.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

In General

Referring now to the drawings, and particularly to FIG. 1, there is shown an elevational view of a fuel assembly, represented in vertically foreshortened form and being generally designated by the numeral 10. The fuel assembly 10 is the type used in a pressurized water reactor (PWR) and basically includes a lower end structure or bottom nozzle 12 for supporting the assembly on the lower core plate (not shown) in the core region of a reactor (not shown), and a number of longitudinally extending guide tubes or thimbles 14 which project upwardly from the bottom nozzle 12. The assembly 10 further includes a plurality of transverse grids 16 axially spaced along the guide thimbles 14 and an organized array of elongated fuel rods 18 transversely spaced and supported by the grids 16. Also, the assembly 10 has an instrumentation tube 20 located in the center thereof and an upper end structure or top nozzle 22 attached to the upper ends of the guide thimbles 14. With such an arrangement of parts, the fuel assembly 10 forms an integral unit capable of being conventionally handled without damaging the assembly parts.

As mentioned above, the fuel rods 18 in the array thereof in the assembly 10 are held in spaced relationship with one another by the grids 16 spaced along the fuel assembly length. Each fuel rod 18 includes an elongated hollow cladding tube 23 (FIG. 2) which contains nuclear fuel pellets 24 and is closed at its opposite ends by upper and lower end plugs 26,28 so as to hermetically seal the rod. Commonly, a plenum spring 30 is disposed in the tube 23 between the upper end plug 26 and the pellets 24 to maintain the pellets in a tight, stacked relationship within the rod 18. The fuel pellets 24 composed of fissile material are responsible for creating the reactive power of the PWR. A liquid moderator/coolant such as water, or water containing boron, is pumped upwardly through the guide thimbles 14 and along the fuel rods 18 of the fuel assembly 10 in order to extract heat generated therein for the production of useful work.

To control the fission process, a number of control rods 32 are reciprocally movable in the guide thimbles 14 located at predetermined positions in the fuel assembly 10. Specifically, a rod cluster control mechanism 34 associated with the top nozzle 22 has an internally threaded cylindrical member 36 with a plurality of radially extending flukes or arms 38. Each arm 38 is interconnected to a control rod 32 such that the control mechanism 34 is operable to move the control rods 32 vertically in the guide thimbles 14 to thereby control the fission process in the fuel assembly 10, all in a well-known manner.

Tube Cleaning System

Figure 2:
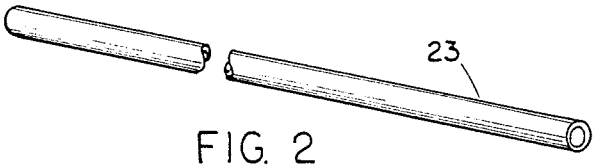
FIG. 2 is a perspective view of a typical fuel rod tube capable of being cleaned by the system and method of the present invention.

Turning now to FIGS. 3 through 6, there is shown an ultrasonic cleaning system, generally designated by the numeral 40 and comprising the preferred embodiment of the present invention, for giving the fuel rod tube 23 of FIG. 2 a thorough cleaning inside and outside during manufacture of the tube. The cleaning system 40 basically includes a cleaning tank 42 holding a quantity of liquid 44, such as water containing a suitable biodegradable detergent, and means in the form of a series of transducers 46 mounted in the tank 42 for generating ultrasonic cavitational energy within the tank water.

More particularly, the elongated cleaning tank 42 includes a receptacle 48 having a bottom wall 50 and pairs of upright spaced-apart opposite side walls 52,54 and end walls 56,58 which are interconnected together and to the bottom wall. The receptacle 48 has a long, narrow rectangular configuration adapting it to accomodate long fuel rod tubes 23, typically being about thirteen feet in length. The receptacle 48 which holds the detergent-laden water 44 is, in turn, is removably mounted in an outer support shell 60 of the tank 42 having a plurality of support legs 62. The series of transducers 46 are mounted in spaced relation on the bottom wall 50 of the tank 42 and arranged in a generally linear pattern which extends between the opposite tank end walls 56,58 and generally parallel to the opposite tank side walls 52,54. As conventionally known, the ultrasonic transducers 46 are devices which convert electrical energy to mechanical energy. When the transducers 46 are attached to a radiating surface, i.e., the bottom wall 50 of the cleaning tank receptacle 48, the mechanical energy is converted to ultrasonic cavitational energy which produces the cleaning. The detergent is used in the water 44 to augment or promote the cleaning action primarily carried out by the ultrasonic energy.

In addition, the cleaning system 40 includes means, generally designated 64, for delivering tubes 23 individually into the liquid 44 within the tank 42. The tube delivering means 64 is composed of a stationarily-disposed upper tube entry ramp 66 and a stationarily-disposed middle tube transfer ramp 68.

The upper ramp 66 includes a plurality of elongated inclined tracks 70 for guiding delivery of tubes 23 in single file fashion into the tank 42. The tracks 70, being preferably four in number, extend generally parallel to one another, are inclined downwardly from above the one side wall 52 toward the opposite side wall 54 of the tank receptacle 48, and are laterally spaced apart between the opposite end walls 56,58 thereof. Also, an elongated shaft 72 is mounted to and extends between the opposite end walls 56,58 of the tank receptacle 48 and pivotally supports the tracks 70 adjacent to tube discharge ends 74 thereof. Further, spaced apart upright support members 76 interconnect the tracks 70 at tube receiving ends 78 thereof and the tank support shell 60 adjacent to the one tank receptacle side wall 52 for mounting the tube receiving ends 78 of the tracks 70 above the one side wall and at a higher elevation than that at which tube discharge ends 74 of the tracks 70 are mounted by the shaft 72. The support members 76 are adjustable vertically (as seen in phantom outline in FIG. 3) for adjusting the elevation of the tube receiving ends 78 of the tracks 70 and thereby the overall inclination of the tracks 70.

The middle ramp 68 includes a plurality of elongated inclined tracks 80 for receiving tubes 23 from the discharge ends 74 of the upper ramp tracks 70 and guiding delivery of tubes in single file fashion into the water 44 in the tank 42. The tracks 80 (shown only in FIG. 3), being preferably four in number also, extend generally parallel to one another, are inclined downwardly from tube entry ends 82 being spaced below the discharge ends 74 of the upper ramp tracks 70 toward the one side wall 52 of the tank receptacle 48, and are laterally spaced apart between the opposite end walls 56,58 thereof. Also, a pair of spaced elongated members 84 mounted to and extending between the opposite end walls 56,58 of the tank receptacle 48 support the middle ramp tracks 80 at a fixed inclined position with their tube entry ends 82 at a substantially higher elevation than tube exit ends 86 thereof.

Further, the cleaning system 40 includes means 88 for feeding the tubes 23 across the tank 42 within the liquid 44 therein such that each tube will pass through and be cleaned by the ultrasonic cavitation energy in the liquid. The tube feeding means 88 is in the form of a lower tube soak ramp which includes a stationarily-disposed plurality of elongated inclined tracks 90 for receiving tubes from the exit ends 86 of the middle ramp tracks 80 and guiding the tubes in single file fashion along a linear path across the tank 42 within the water 44 and above the transducers 46 mounted therein. The tracks 90, being preferably four in number, extend generally parallel to one another, are slightly inclined downwardly from tube receiving ends 92, are spaced below the exit ends 86 of the middle ramp tracks 80 adjacent the one side wall 52 toward the opposite side wall 54 of the tank receptacle 48, and are laterally spaced apart between the opposite end walls 56,58 thereof. Also, an elongated member 94 is mounted to and extends between the opposite end walls 56,58 of the tank receptacle 48 and supports the lower ramp tracks 90 adjacent tube accumulating ends 96 thereof such that the tube receiving ends 92 of the tracks 90 are positioned against the one side wall 52 of the tank receptacle 48 at an elevation slightly higher than that of the tube accumulating ends 96 of the tracks. Triangular shaped end stops 100 are attached to the tracks 90 at their tube accumulating ends 96. As will become clearer below, the end stops 100 are placed at positions along the tracks ends 96 calculated to ensure that only one tube 23 at a time will be removed from the tracks 90.

Finally, the cleaning system 40 includes means 102 for removing tubes one at a time from the liquid 44 within the tank 42 to a tube discharge location 104, such as the surface of an outlet table (not shown). The tube removing means 102 takes the form of a conveyor which is supported in a generally vertical position on the opposite other side wall 54 of the tank receptacle 48. The conveyor 102 is operable to pick up one tube 23 at a time at the accumulating ends 96 of the lower ramp tracks 90 and lift the one tube from the water 44 to the discharge location 104 above the tank 42 in order to remove the tube from the tank before another tube is picked up by the conveyor 102.

More particularly, the conveyor 102 includes a plurality of flexible drive chains 106, preferably three in number, mounted about and extending between respective upper drive sprockets 108 and lower follower sprockets 110. The follower sprockets 110 are rotatably mounted on a shaft 112 extending between lower brackets 114 attached on the tank receptacle side wall 54 below the surface of the liquid 44 in the tank 42. The drive sprockets 108 are attached on respective shafts 116 rotatably mounted on upper brackets 118 on the side wall 54 above the water surface and driven by respective drive units 120. The arrangements of chains 106 and sprockets 108,110 extend generally parallel to one another and are laterally spaced apart between the opposite end walls 56,58 of the tank receptacle 48.

Figure 3:
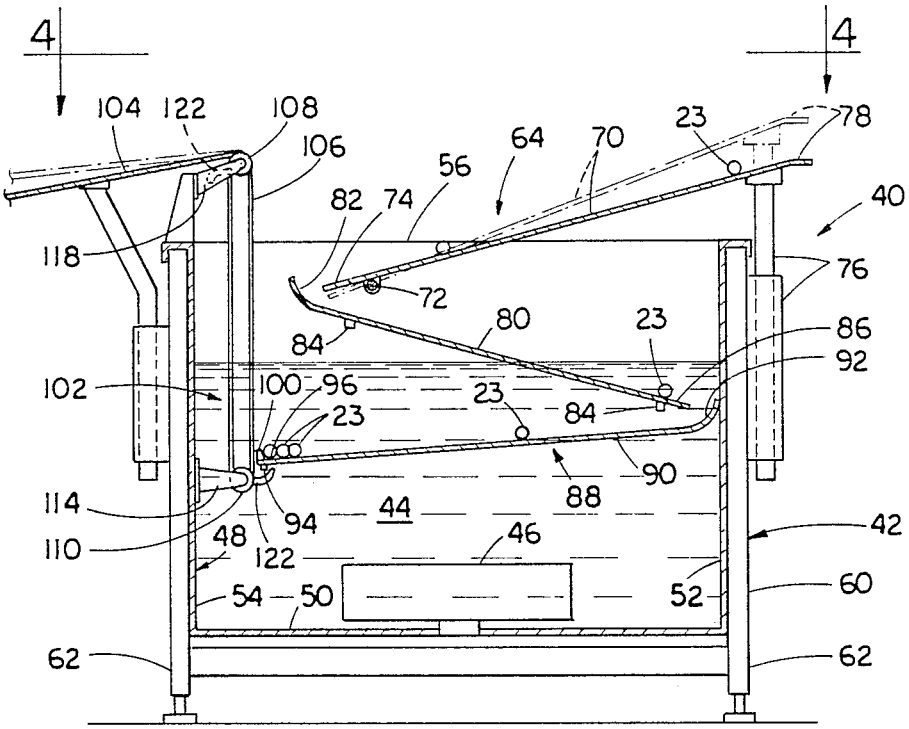
FIG. 3 is an end elevational view of the tube cleaning system of the present invention.
Figure 6:
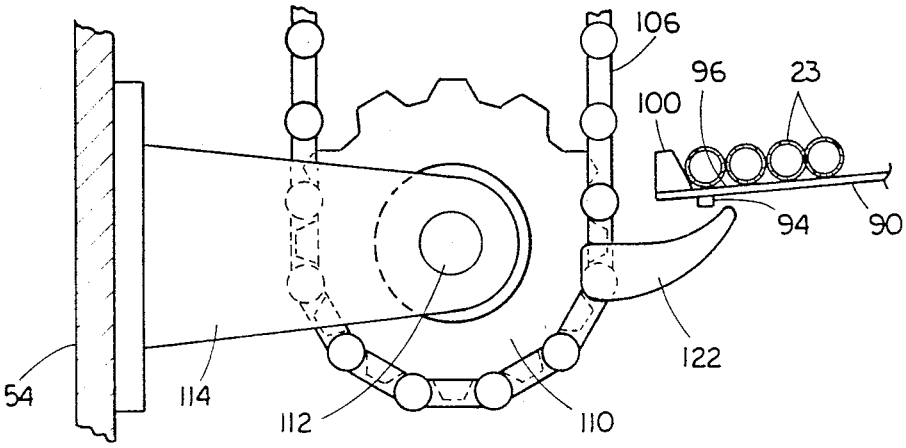
FIG. 6 is an enlarged detailed view of a fragmentary portion of the tube removal apparatus of FIG. 5 as seen along line 6—6 of FIG. 4.
Figure 4:
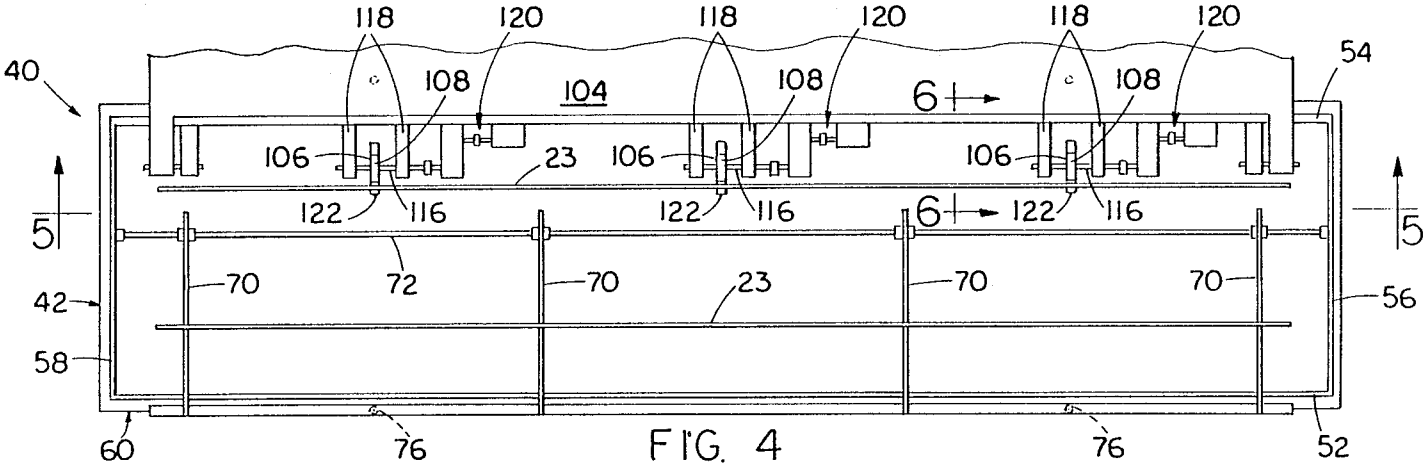
FIG. 4 is a top plan view of the cleaning system as seen along line 4—4 of FIG. 3.
Figure 5:
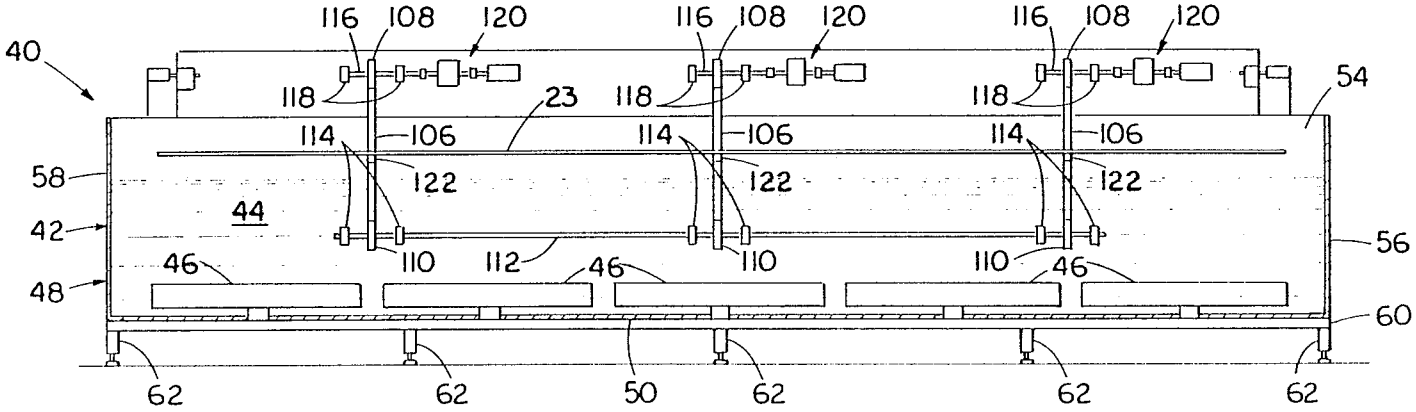
FIG. 5 is a sectional side elevational view of the tube removal apparatus of the tube cleaning system as seen along line 5—5 of FIG. 4.

Each of the drive chains 106 has a pair of tube cradles 122 attached thereto, with each cradle being positioned on the drive chain at a distance equal to approximately one-half the length of the drive chain from the other cradle. The drive chains 106 define generally parallel endless paths extending between the tube accumulating ends 96 of the lower ramp tracks 90 and the tube discharge location 104 above the tank 42. In view of the distance between the tube cradles 122 attached to each of the flexible drive chains 106, when corresponding upper ones of the cradles in the pairs thereof on the drive chains are disposed in an upper tube unloading position adjacent the tube discharge location 104 as seen in FIG. 3, corresponding lower ones of the cradles in the pairs thereof are disposed in a tube loading position just below the end stops 100 at the tube accumulating ends 96 of the lower ramp tracks 90 as seen in FIGS. 3 and 6. In such way, the corresponding cradles 122 in the pairs thereof are adapted to travel in generally parallel endless paths which pass adjacent the end stops 100 and intersect with a leading one of the tubes being stationarily positioned in single file fashion upstream of the end stops 100 at the tube accumulating ends 96 of the lower ramp tracks 90 so that the corresponding cradles 122 will pick up only the leading one tube 23 at a time and lift it to the discharge location 104 being another tube is picked up.

The cleaning system 40 also includes a pump/filtration arrangement (not shown) for circulating and filtering the water in the tank to remove foreign matter therefrom which has been cleaned from the tubes.

From the foregoing description, it will be understood that tubes 23 will be gravity fed into the tank via a switchback path defined by the stationarily-disposed upper and middle ramp tracks 70,80 and then along a generally linear path defined by the stationarily-disposed lower ramp tracks 90 through the water to the end stops 100. Preferably, sensors (not shown) strategically placed along the tracks 70,80,90 and drive chains 106 will monitor the passage of each tube through the tank. Signals from these sensors are fed to a controller (not shown) which will track the movement of each tube and initiate the removal of each tube by starting the drive units 120 to drive the chains at the appropriate time. In such manner, each tube will soak in the ultrasonic cavitation energy for the same predetermined amount of time as every other tube. The tubes are also removed from the tank 42 on a first-in/first-out basis.

To drain liquid from the inside of the tube 23, one of the drive chains 106 will momentarily slow down or stop as the other chains continue to move. Then the respective motions of the drive chains 106 will be reversed to relevel the tube. After being releveled, the tube is moved to the apex of the upper drive sprockets 108 where the drive units 120 are stopped, causing the tube to roll onto the discharge surface 104.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

We claim:

1. A system for ultrasonically cleaning tubes, comprising:

(a) a cleaning tank holding a quantity of liquid and having a tube receiving end located above said liquid;

(b) means for generating ultrasonic cavitation energy within said liquid in said tank;

(c) stationarily-disposed means defining a switchback path leading into said liquid from said tube receiving end of said tank above said liquid for delivery tubes by gravity individually in single file fashion from said tube receiving end of said tank into said liquid within said tank;

(d) means stationarily-disposed and submerged in said liquid defining a generally linear inclined path for feeding said tubes by gravity in single file fashion from said switchback path across said tank within said liquid therein such that each tube will pass through and be cleaned by said cavitation energy in said liquid, said tube feeding means having opposite tube receiving and accumulating ends and including stop means disposed at said tube accumulating end for stationarily accumulating tubes upstream of said stop means in the same single file fashion as they are fed along said linear path for said switchback path; and (e) means located adjacent said tube accumulating end of said tube feeding means for removing said tubes at said tube accumulating end thereof from said liquid within said tank, said tube removing means including (i) a plurality of flexible members extending generally parallel to one another and being laterally spaced apart from one another, said flexible members being operable for movement about endless paths extending between said tube accumulating end of said tube feeding means and a tube discharge location above said tank, and (ii) corresponding pairs of tube cradles attached to said flexible members at locations thereon being spaced apart by distances equal to approximately one-half the lengths of said flexible members such that corresponding ones of said cradles in said pairs thereof are disposed in an unloading position adjacent said tube discharge location when corresponding other of said cradles in said pairs thereof are disposed in a loading position adjacent said tube feeding means at said tube accumulating end thereof, said corresponding cradles in said pairs thereof being adapted to travel in endless paths, as said flexible members move about their endless paths, so as to pass adjacent said stop means and intersect with only a leading one of the tubes being stationarily positioned in single file fashion upstream of said stop means at said tube accumulating end of said tube feeding means such that said corresponding cradles in said pairs thereof will pick up only the leading one tube at a time.

2. The system as recited in claim 1, wherein said tube delivery means includes:

upper and middle pluralities of oppositely included stationarily-disposed tracks defining said switchback path along which said tubes are fed by gravity individually into said liquid within said tank, said tracks in each plurality thereof extending generally parallel to one another and being laterally spaced apart from one another.

3. The system as recited in claim 2, wherein said tube delivery means also includes:

means mounted to said tank and supporting said tracks of said upper plurality thereof and being operable for pivotally adjusting the inclination of said tracks.

4. The system as recited in claim 3, wherein said tube delivery means also includes:

means mounted to said tank and supporting said tracks of said middle plurality thereof for maintaining the inclination of said tracks in a fixed relationship.

5. The system as recited in claim 2, wherein said tube feeding means includes:

a lower plurality of elongated slightly inclined stationarily-disposed tracks located below said delivering means and across said tank and defining said generally linear path along which said tubes are fed by gravity individually through said ultrasonic cavitation energy in said liquid, said tracks extending generally parallel to one another and being laterally spaced apart from one another.

6. The system as recited in claim 5, wherein said tube feeding means also includes:

means mounted to said tank and supporting said tracks of said lower plurality thereof and being operable for pivotally adjusting the inclination of said tracks.

7. A system for ultrasonically cleaning tubes, comprising:

(a) an elongated cleaning tank having a bottom wall and pairs of upright opposite side walls and end walls, said walls connected together and adapting said tank to hold a quantity of detergent-containing water;

(b) a series of spaced apart transducers mounted on said bottom wall of said tank and arranged in a generally linear pattern extending between said opposite end walls of said tank and generally parallel to said opposite side walls thereof, said transducers for generating ultrasonic cavitational energy within said water;

(c) an upper inclined tube entry ramp stationarily-supported at a tube receiving end from one of said tank side walls and at an opposite tube discharge end between said tank end walls for guiding delivery of tubes by gravity in single file fashion into said tank toward the other of said side walls thereof;

(d) a middle tube transfer ramp being oppositely inclined relative to said inclined upper ramp, having opposite tube entry and exit ends and being stationarily-supported between said tank side walls below said upper ramp for receiving tubes at said entry end of said middle ramp from said discharge end of said upper ramp and guiding delivery of tubes by gravity in single file fashion into said water in said tank toward said one of said side walls thereof to said exit of said middle ramp;

(e) a lower tube soak ramp being oppositely inclined relative to said inclined middle ramp, having opposite tube receiving and accumulating ends and being stationarily-supported between said tank side walls below said middle ramp for receiving tubes at said receiving end of said lower ramp for receiving tubes at said receiving end of said lower ramp from said exit end of said middle ramp and guiding said tubes in gravity-fed single file fashion across said tank within said water and above said transducers therein to said tube accumulating end of said lower ramp such that each tube will pass through and be cleaned by said cavitation energy in said water, said lower ramp including stop means disposed at said tube accumulating end for stationarily accumulating tubes upstream of said stop means in the same single file fashion as they are guided across said tank from said exit end of said middle ramp; and (f) a conveyor supported in a generally vertical position on the opposite other side wall of said tank and being operable for picking up only a leading one tube at a time at said accumulating end of said lower ramp and lifting said one tube from said water to a discharge location above said tank to remove said tube from said tank before another tube is picked up by said conveyor, said conveyor including (i) a plurality of flexible members extending generally parallel to one another and being laterally spaced apart between said opposite end walls of said tank, said flexible members being operable for movement about endless paths extending between said tube accumulating end of said lower ramp and said tube discharge location above said tank, and (ii) corresponding pairs of tube cradles attached to said flexible members at locations thereon being spaced apart by distances equal to approximately one-half the lengths of said flexible members such that corresponding ones of said cradles in said pairs thereof are disposed in an unloading position adjacent said tube discharge location when corresponding others of said cradles in said pairs thereof are disposed in a loading position adjacent said tube accumulating end of said lower ramp, said corresponding cradles in said pairs thereof being adapted to travel in endless paths, as said flexible members move about their endless paths, so as to pass adjacent said stop means and intersect with only a leading one of the tubes being stationarily positioned in single file fashion upstream of said stop means at said tube accumulating end of said lower ramp such that said corresponding cradles in said pairs thereof will pick up only the leading one tube at a time.

8. The system as recited in claim 7, wherein said upper ramp includes:

a plurality of elongated stationarily-disposed inclined tracks extending generally parallel to one another and from above said one side wall downwardly toward said opposite side wall of said tank and being laterally spaced apart between said opposite end walls of said tank.

9. The system as recited in claim 8, wherein said upper ramp also includes:

an elongated shaft mounted to and extending between said opposite end walls of said tank and pivotally supporting said tracks adjacent to tube discharge ends of said tracks; and support members interconnecting said one side wall of said tank and tube receiving ends of said tracks for mounting said receiving ends of said tracks above said one tank side wall, said support members mounting said tube receiving ends of said tracks at a higher elevation than that at which said tube discharge ends of said tracks are mounted by said shaft.

10. The system as recited in claim 9, wherein said support members are adjustable for adjusting the elevation of said tube receiving ends of said tracks and thereby the inclination of said tracks.

11. The system as recited in claim 7, wherein said middle ramp includes:

a plurality of elongated stationarily-disposed inclined tracks extending generally parallel to one another from tube entry ends spaced below said tube discharge ends of said upper ramp tracks downwardly toward said one side wall of said tank and being laterally spaced apart between said opposite end walls of said tank.

12. The system as recited in claim 11, wherein said middle ramp also includes:

a pair of spaced elongated members mounted to and extending between said opposite end walls of said tank and supporting said middle ramp tracks with said tube entry ends thereof at a substantially higher elevation than tube exit ends thereof.

13. The system as recited in claim 7, wherein said lower ramp includes:

a plurality of elongated stationarily-disposed inclined tracks extending generally parallel to one another from tube receiving ends spaced below said tube exit ends of said middle ramp tracks adjacent said one tank side wall downwardly toward said opposite tank side wall and being laterally spaced apart between said opposite end walls of said tank.

14. The system as recited in claim 13, wherein said lower ramp also includes:

an elongated member mounted to and extending between said opposite end walls of said tank and supporting said lower ramp tracks adjacent said tube accumulating ends thereof such that said tube receiving ends of said lower ramp tracks are positioned against said one tank side wall at an elevation slightly higher than that of said tube accumulating ends thereof.

* * * * *